US006908215B2

(12) United States Patent
Wu

(10) Patent No.: US 6,908,215 B2
(45) Date of Patent: Jun. 21, 2005

(54) DYNAMICALLY SENSITIZED DECORATIVE LIGHTING EQUIPMENT

(76) Inventor: Jeng-shyong Wu, No. 14, Alley 1, Lane 326, Shin-Pin Road, Shinchu (TW)

( * ) Notice: Subject to any disclaimer, the term of this patent is extended or adjusted under 35 U.S.C. 154(b) by 0 days.

(21) Appl. No.: 10/336,517

(22) Filed: Jan. 3, 2003

(65) Prior Publication Data

US 2004/0130895 A1 Jul. 8, 2004

(51) Int. Cl.[7] ..... F21S 13/14
(52) U.S. Cl. ..... 362/252; 362/123; 362/249; 362/806
(58) Field of Search ..... 362/122, 123, 362/249, 250, 251, 252, 806, 808

(56) References Cited

U.S. PATENT DOCUMENTS 5,379,202 A * 1/1995 Daun ..... 362/252
5,639,157 A * 6/1997 Yeh ..... 362/567
5,957,564 A * 9/1999 Bruce et al. ..... 362/84
6,220,718 B1 * 4/2001 Burgess ..... 362/101
6,254,250 B1 * 7/2001 Shieh ..... 362/123
6,478,455 B2 * 11/2002 Ahroni ..... 362/352

* cited by examiner

*Primary Examiner*—John Anthony Ward
(74) *Attorney, Agent, or Firm*—McGlew and Tuttle, P.C.

(57) ABSTRACT

Disclosed is a dynamically sensitized decorative lighting equipment wherein a plurality of lighting elements such as miniature decorative lamps or LEDs is divided in several individual groups which are hung on a structural framework and configurated into special patterns of variety of artistic contours to exhibit a unique and dynamical sensitization lighting effect by partially constantly turning on and partially alternatively glittering.

20 Claims, 12 Drawing Sheets

DYNAMICALLY SENSITIZED DECORATIVE LIGHTING EQUIPMENT

BACKGROUND OF THE INVENTION

1. Field of the Invention

The present invention relates to decorative lighting equipment, and in particular, to a plurality of lighting elements such as miniature decorative lamps divided in several individual groups which are hung on a structural framework and configurated into special patterns of various artistic contours to exhibit a unique and dynamical sensitization lighting effect.

2. Description of the Prior Art

Glittering miniature lamps are favorite decorative articles in festival occasions and Christmas time, or for patio and garden lighting, and also applicable for advertisement. In bygone time, marvelous sensitization effect cannot be fully attained owing to limited capacity of unit controller and a power circuit that restricts amount of lamps allowable to be installed thereof. The conventional decorative lighting which is usually hanging a plurality of miniature lamps on trees or along extended ropes and glittering alternatively the adjacent lamps is too monotonous. Besides, the trees and ropes are difficult to be configurated into a desired contour, and for lighting a large area using a lot of lamps, a large controller and a big conductor size is required which calls for expensive installation cost.

SUMMARY OF THE INVENTION

For rectifying the aforesaid disadvantages inherent to the conventional technique for decorative lighting, an object of the present invention is to provide a decorative lighting equipment which can be configurated into specially unique patterns of various artistic contours by hanging plurality of miniature lamps or LEDs on a preformed structural framework so as to attain an unique and appealing lighting effect.

Another object of the present invention is to provide a decorative lighting equipment that a plurality of miniature lamps or LEDs is divided in several groups to glitter alternatively one after another or keep constantly turning on according to individual controls so as to reduce the capacity of the unit controller size and the conductor size as well.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
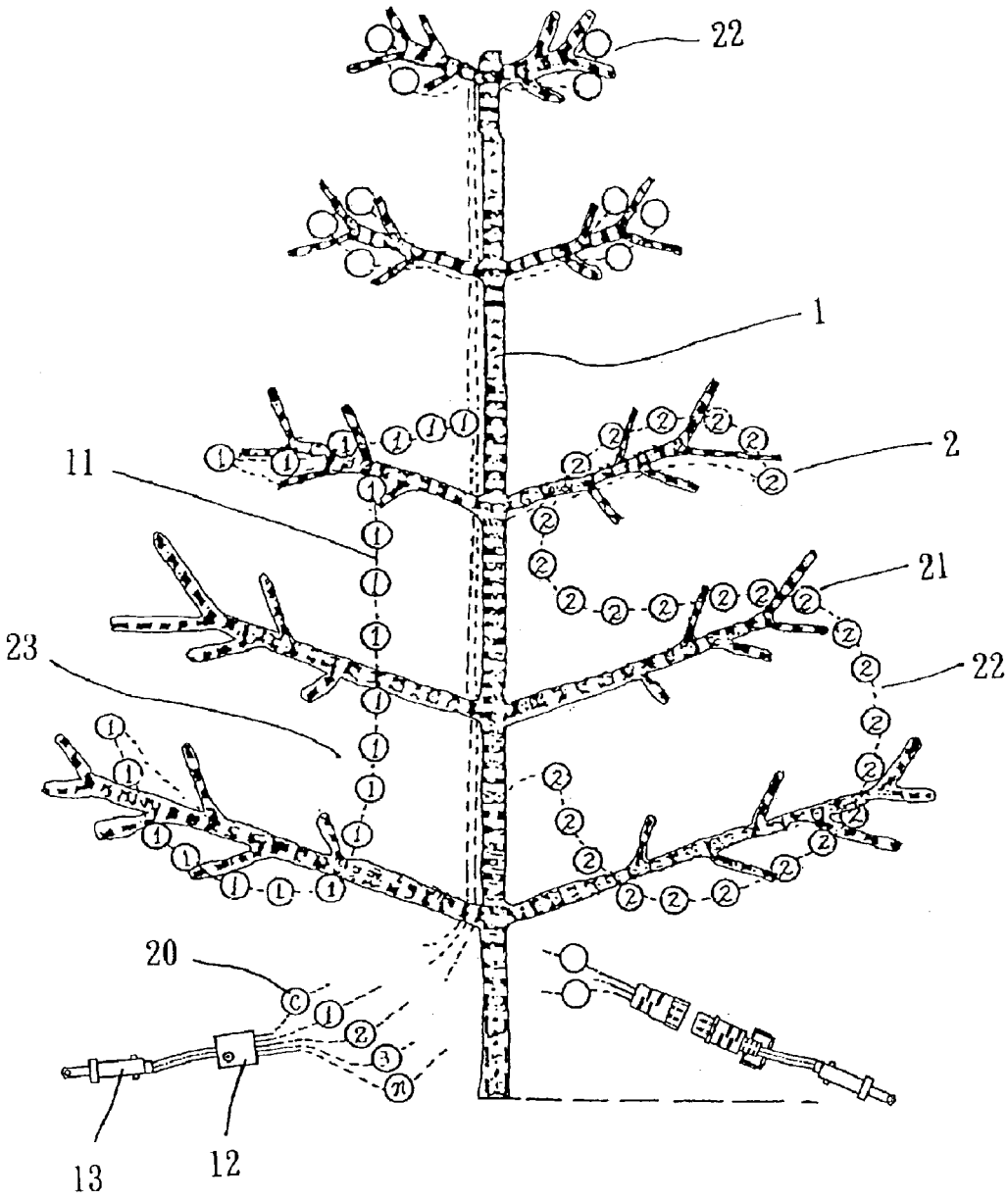
FIG. 1 is a plan view of the present invention.

Referring to FIG. 1, the decorative lighting equipment of the present invention comprises a structural framework 1 and a string of lamps 2, the framework 1 is configurated in a tree shape on which several conductors 11 are meandering along. The conductors 11 are connected to a power supply socket 13 via a functional gang controller 12. A plurality of lighting elements (LEDs or miniature lamps) 21 is mutually connected in series or combined series and parallel maimer with the conductors 11 and respectively distributed in a relevant position. The lighting elements 21 are divided into lamp groups 22, 23 having different contours in the manner the group 22 is constantly turned on (like "○" for a constantly lit lamp) while the other groups 23, 24 are alternatively glittering (like "①② . . . " for a glittering lamp). All the lamp groups 22, 23, 24 are connected to the gang controller 12 and a pilot wire 20 is drawn out from the controller 12 for controlling operation of aforesaid lamp groups so as to achieve a dynamic sensitized decorative lighting effect.

Figure 2:
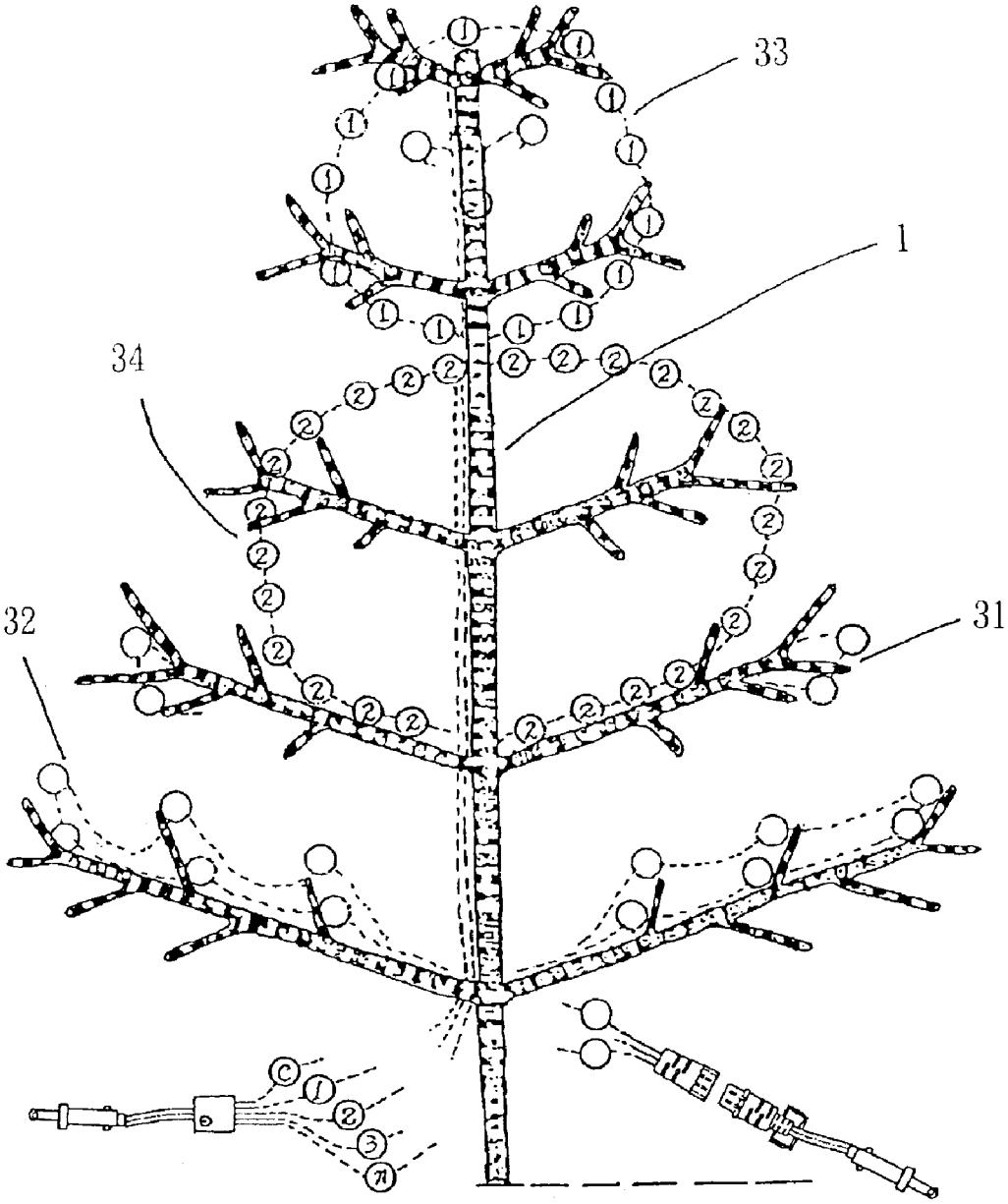
FIG. 2 is a view showing a second embodiment.

Meanwhile, various embodiments developed from the foregoing basic aspect will be given below:

In the second embodiment shown in FIG. 2, two constantly turned on lamp groups 31, 32 are installed at two lower sides of the framework 1 with each occupying one side, while two alternatively glittering lamp groups 33, 34 are installed on upper portion of the framework 1 to form a round snowman figure. All lamp groups 31, 32, 33, 34 are connected to a gang controller 13.

Figure 3:
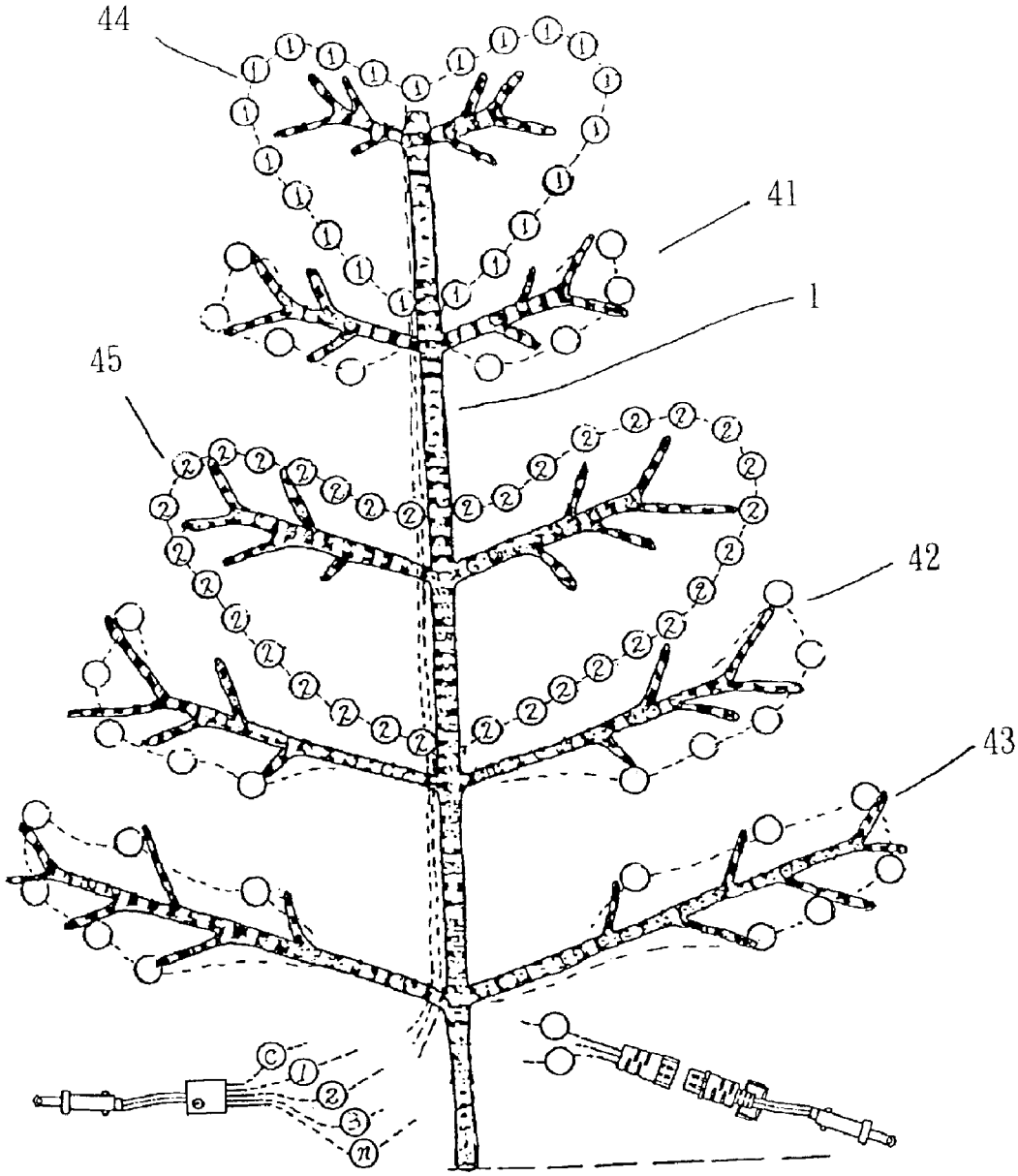
FIG. 3 is a view showing a third embodiment.

In the third embodiment shown in FIG. 3, constantly turned on lamp groups 41, 42, 43 are stacked up like ladder stages at the lower portion of the framework 1, while two cordial shaped alternatively glittering lamp groups 44, 45 are occupying respectively the top and the middle portions thereof.

Figure 4:
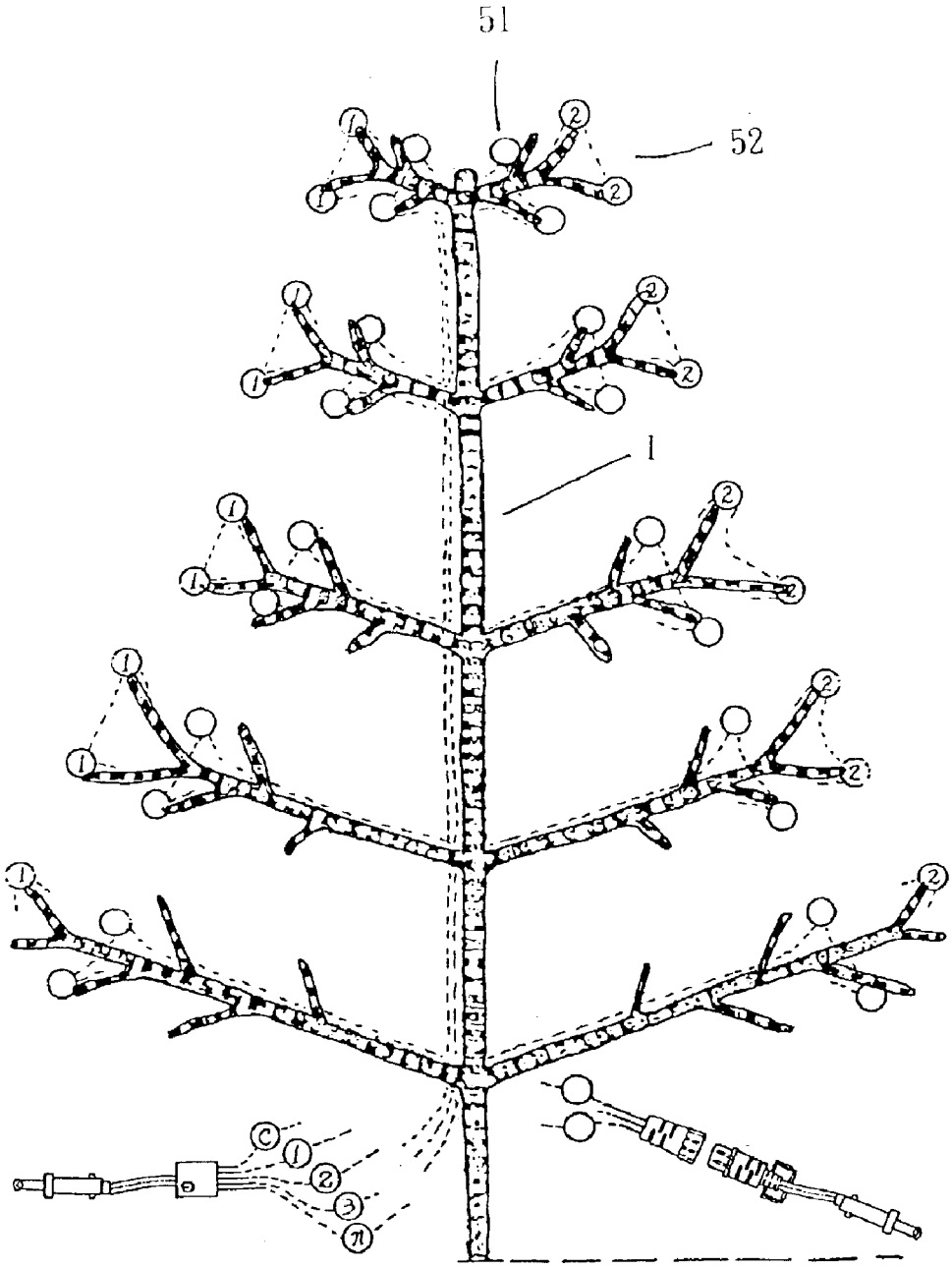
FIG. 4 is a view sowing a fourth embodiment.

In the fourth embodiment shown in FIG. 4, a Δ shaped constantly, turned on lamp groups 51 and a Δ shaped glittering lamp groups 52 are disposed along the twigs of the tree-shaped framework 1 in the manner each group occupies outerside and innerside of right and left twigs alternatively so that the whole structure may look like a waving wand when the lamp groups are energized.

Figure 5:
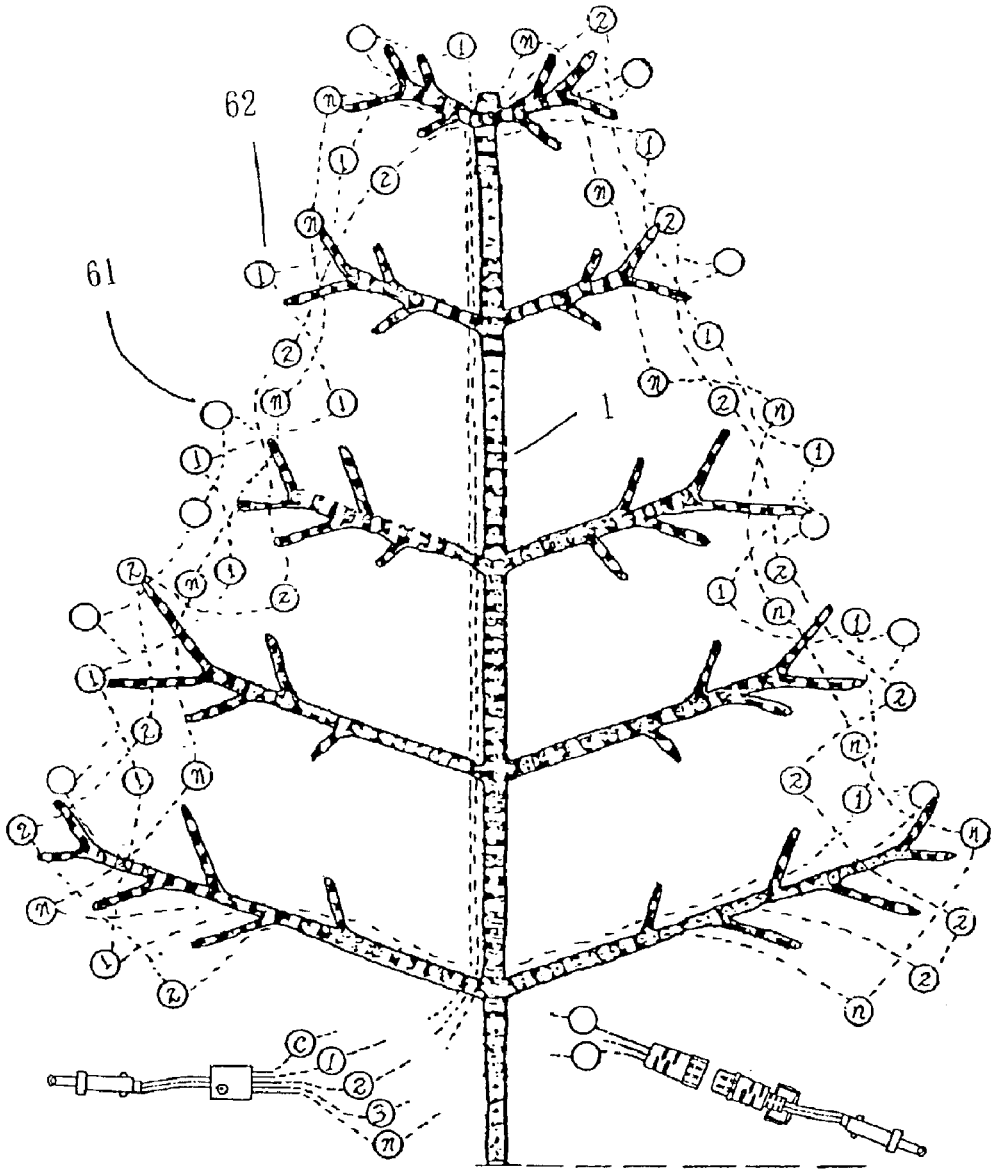
FIG. 5 is a view showing a fifth embodiment.

In the fifth embodiment shown in FIG. 5, a sting of constantly turned on lamp group 62 is allayed around the profile of the framework 1 in the manner encircling another sting of glittering lamp group 61.

Figure 6:
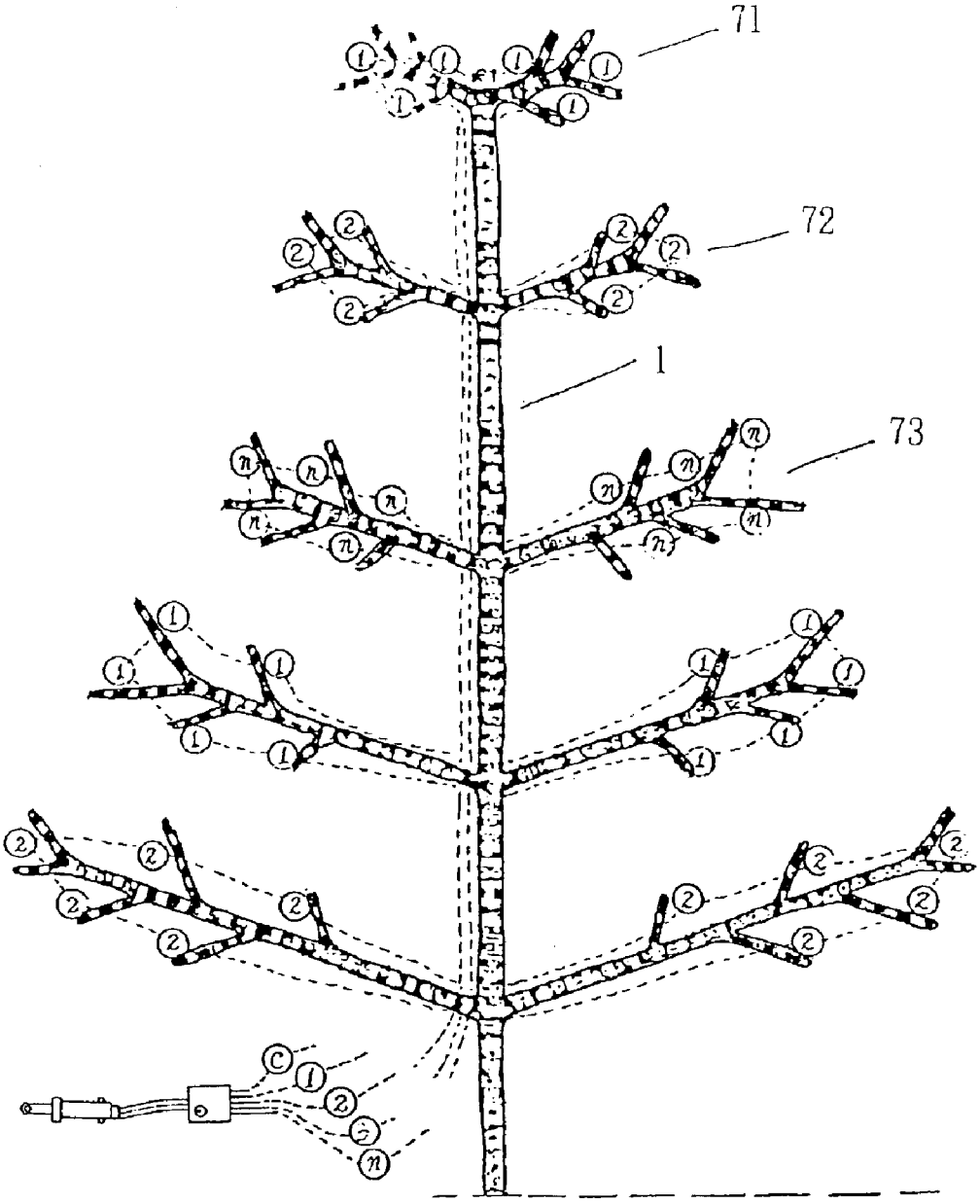
FIG. 6 is a view showing a sixth embodiment.

In the sixth embodiment shown in FIG. 6, several alternatively glittering lamp groups T1, T2, T3 . . . are hung orderly on the framework 1 in a stepped arrangement so as to glitter in a staggering manner.

Figure 7:
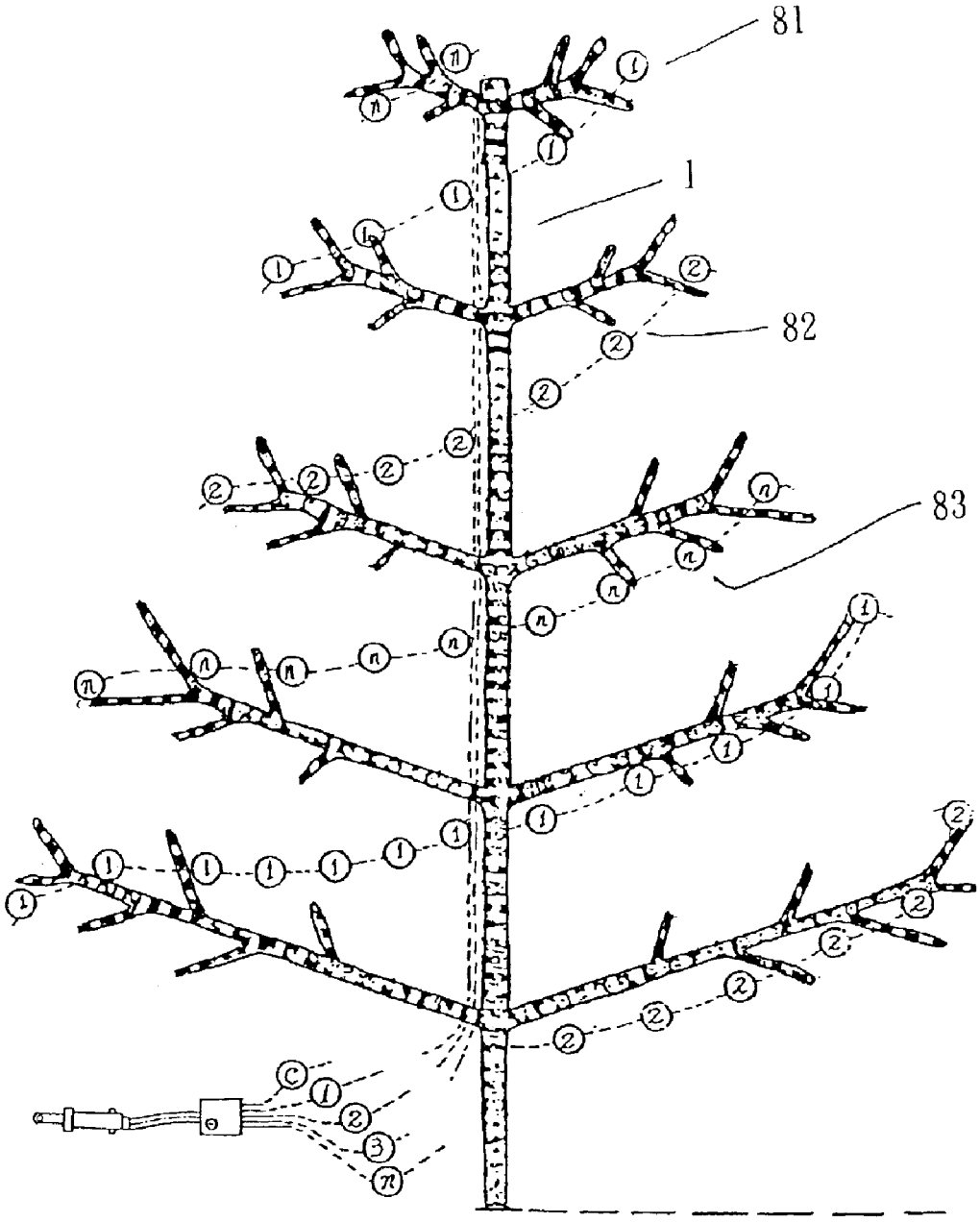
FIG. 7 is a view showing a seventh embodiment.

In the seventh embodiment shown in FIG. 7, several alternatively glittering lamp groups 81, 82, 83 . . . are hung along the twigs of the tree shaped framework 1 in a sloping manner.

Figure 8:
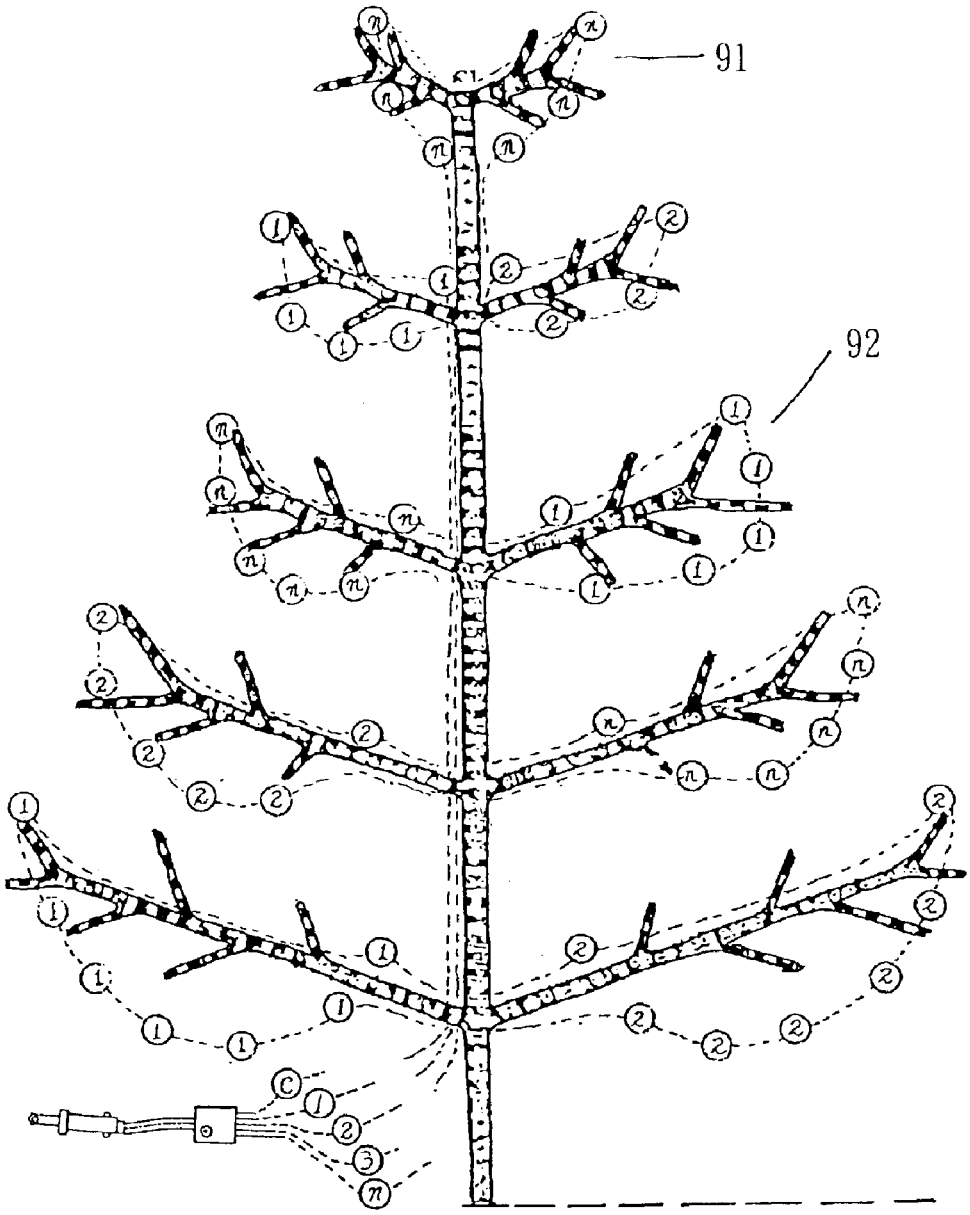
FIG. 8 is a view showing an eighth embodiment.

In the eighth embodiment shown in FIG. 8, alternatively glittering lamp groups 91, 92 . . . are hung at random on the tree shaped framework 1.

Figure 9:
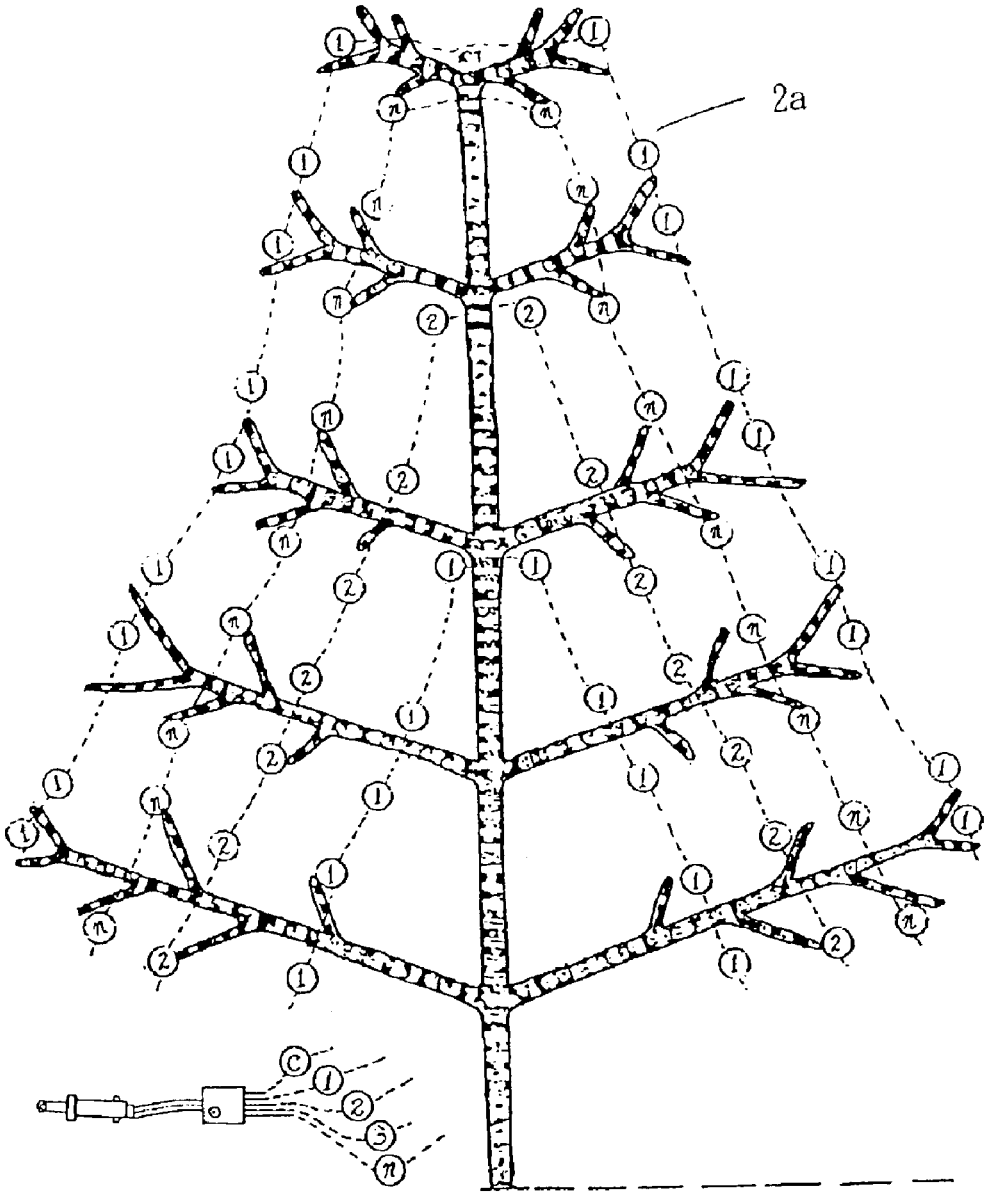
FIG. 9 is a view showing a ninth embodiment'

In the ninth embodiment shown in FIG. 9, the glittering lamp groups 2*a* are configurated in an umbrella shape.

Figure 10:
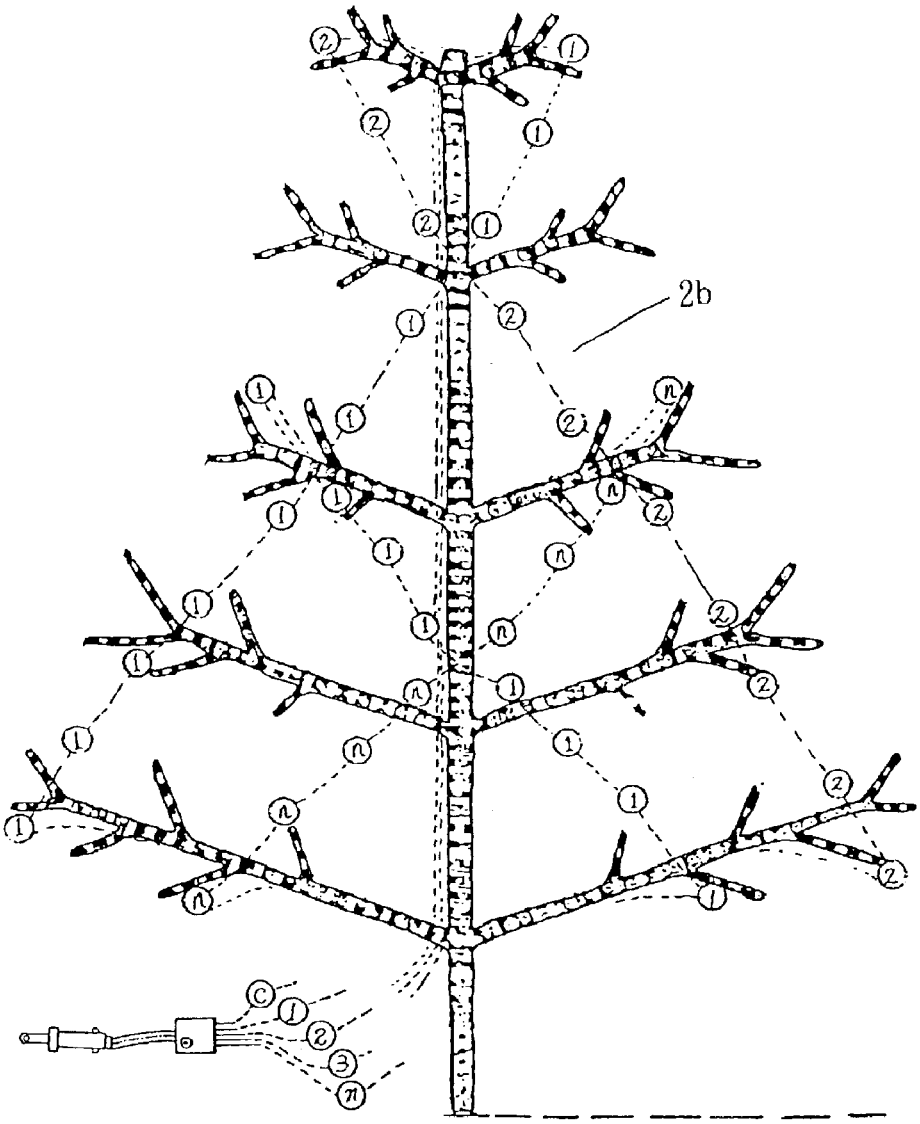
FIG. 10 is a view showing a tenth embodiment.

In the tenth embodiment shown in FIG. 10, the glittering lamp groups 2*b* are configurated in a cross truss shape.

Figure 11:
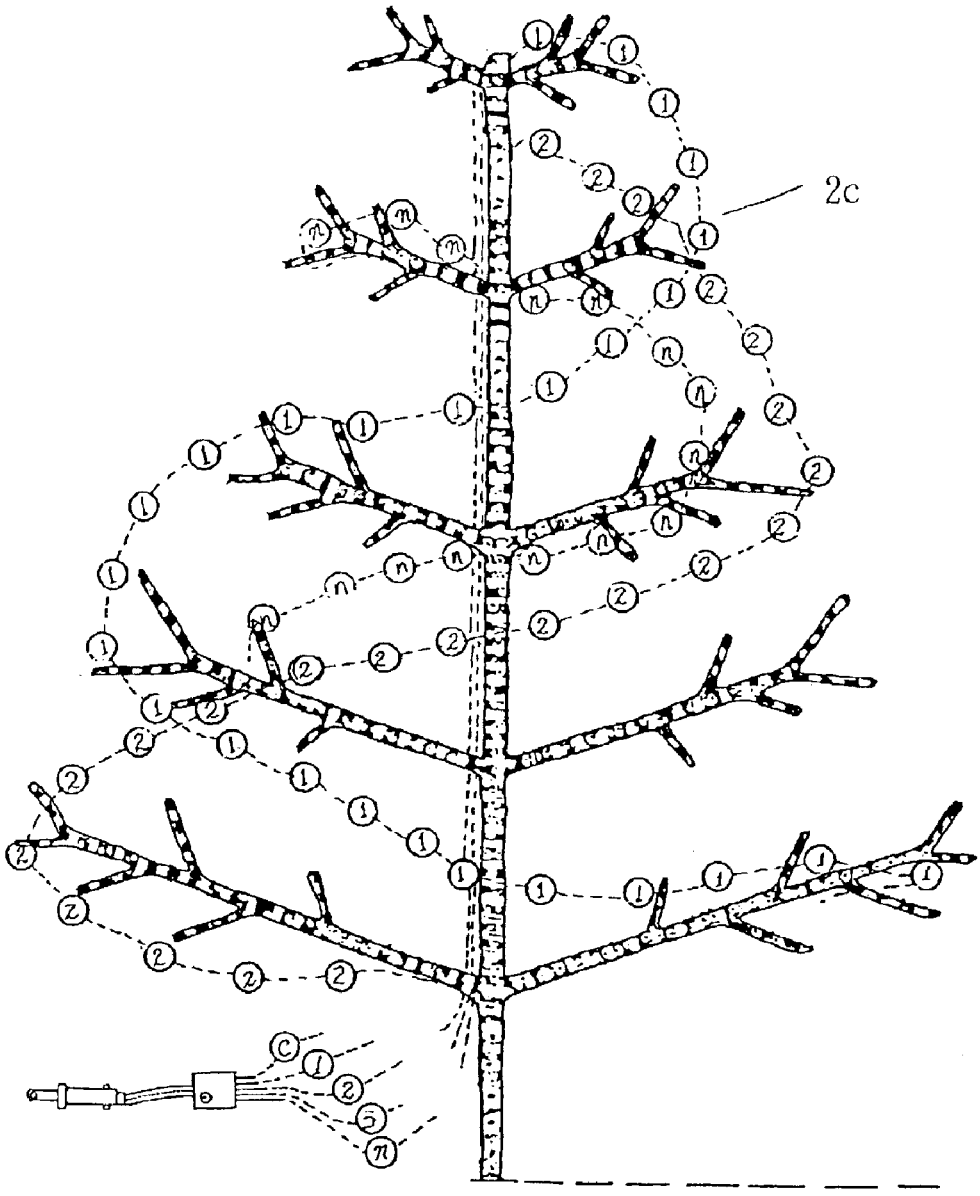
FIG. 11 is a view showing an eleventh embodiment.

In the eleventh embodiment shown in FIG. 11, the glittering lamp groups 2*c* are configurated in a S shape.

Figure 12:
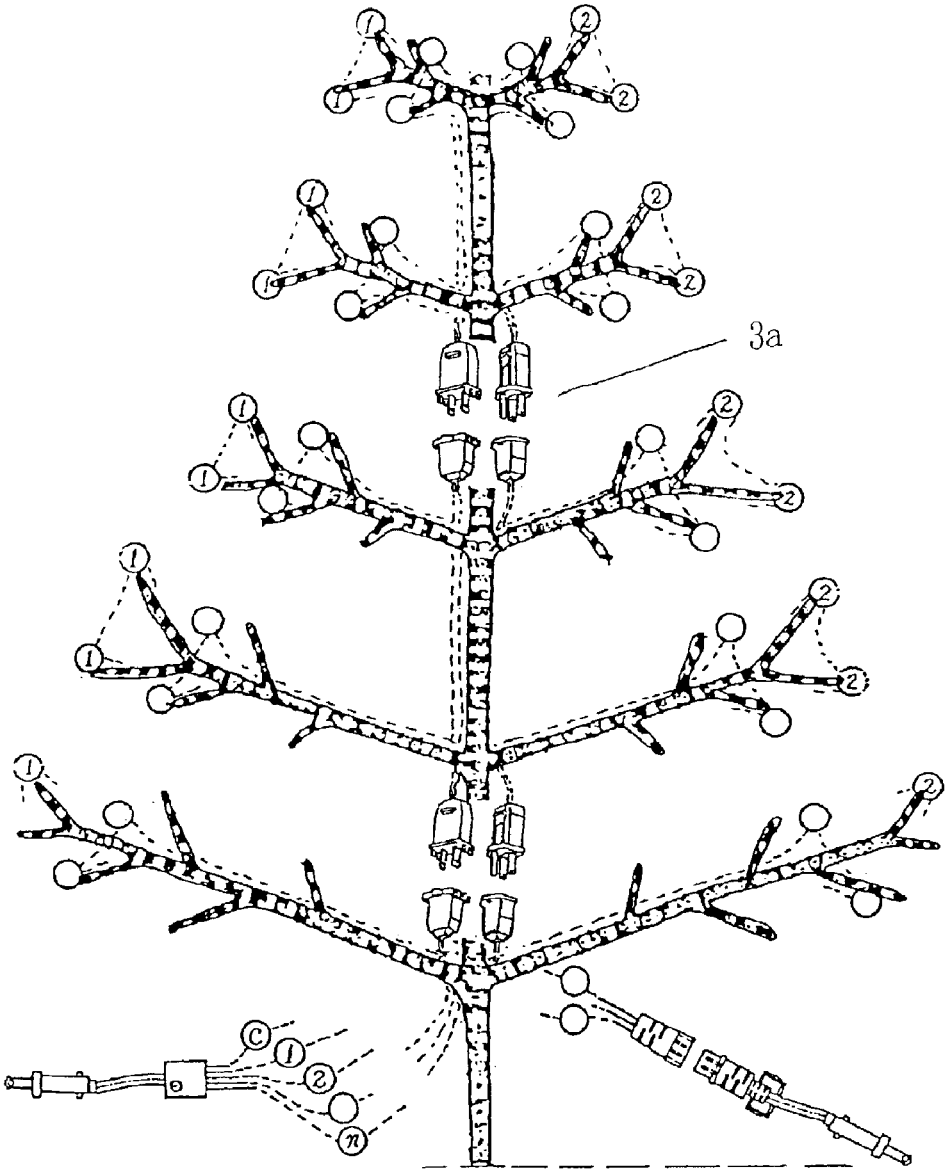
FIG. 12 is a view showing a twelfth embodiment.

As for connector means for individual lamp groups, a plug 3*a* is provided as shown in FIG. 12.

The present invention may be embodied in many other forms without departing from the scope thereof which should be determined by the appended claims and the legal equivalents father than by the examples given.

What is claimed is:

1. An enhanced illuminating apparatus comprising:

a frame defining a particular structure;

a first illuminating means on said frame;

a second illuminating means on said frame;

a multiple controller means for simultaneously controlling more than one illuminating means with different lighting traits wherein said multiple controller means allows said first illuminating means to include at least one lighting trait of constantly on, completely blinking, sequentially flickering, dimming, steadily turning on and off, and glittering with a defined shape and wherein said multiple controller simultaneously allows said second illuminating means to include at least one contrasting lighting trait of constantly on, completely blinking, sequentially flickering, dimming, steadily turning on and off and glittering with a defined shape in a non-sequential manner different from lighting trait of said first illuminating means;

a powering connection means for connecting said multiple illuminating controller to said first and second illuminating means and powering said first and second illuminating means.

2. An enhanced illuminating apparatus as in claim 1 wherein said first illuminating means provides background illumination with a shape illumination corresponding substantially to said particular structure and said second illuminating means provides illumination corresponding to said second shape that is distinct from said background illumination but is within a region of said background illumination.

3. The enhanced illuminating apparatus as in claim 1, wherein said lighting elements are incandescent miniature lamps or LEDs.

4. The enhanced illuminating apparatus as in claim 1, wherein said lighting elements are provided with lamp bases.

5. The enhanced illuminating apparatus in claim 1, wherein said gang functional controller is connected to several power incoming and several power outgoing conductors, said outgoing conductor can be formed into several loop circuits, so as to control on-off, dimming and glittering the selected lamp groups according to a prescribed order.

6. The enhanced illuminating apparatus as in claim 1, wherein said structural framework is formed into a tree shape, a planar shape, or a three-dimensional figure.

7. The enhanced illuminating apparatus as in claim 1, wherein said lamp groups hung on said framework are configured into a letter or letters.

8. The enhanced illuminating apparatus as in claim 1, wherein said lamp groups hung on said framework are configured into a picture pattern.

9. The enhanced illuminating apparatus as in claim 1, wherein said lamp groups hung on said framework are configured into a cordial shape.

10. The enhanced illuminating apparatus in claim 1, wherein said lamp groups hung on said framework are configured into a straight line.

11. The enhanced illuminating apparatus as in claim 1, wherein said lamp groups hung on said framework are configured into a curved line.

12. The enhanced illuminating apparatus as in claim 1, wherein said lamp groups hung on said framework are configured into an umbrella shape.

13. The enhanced illuminating apparatus as in claim 1, wherein said lamp groups hung on said framework are configured into a letter X.

14. The enhanced illuminating apparatus as in claim 1, wherein said lamp groups hung on said framework are configured into a letter S.

15. The enhanced illuminating apparatus as in claim 1, wherein said lamp groups are glittering alternatively from top to bottom, or from bottom to top.

16. The enhanced illuminating apparatus as in claim 1, wherein said lamp groups are glittering alternatively from left to right, or from right to left.

17. The enhanced illuminating apparatus as in claim 1, wherein said lamp groups are arrayed in a sloping manner on said framework and glitter alternatively.

18. The enhanced illuminating apparatus as in claim 1, wherein said lamp groups are disposed at random on said framework and glitter alternatively in staggering manner.

19. The enhanced illuminating apparatus as in claim 1, wherein said lamp groups are hung on said framework three dimensionally and glitter alternatively outwardly or inwardly.

20. The enhanced illuminating apparatus as in claim 1, further comprising a first lamp group which is being constantly turned on and a second lamp group which is being alternatively glittering wherein said first and second lamp groups are mixed together to create an overall visual illumination effect of said decorative lighting equipment being partially constantly lighted by said first lamp and partially glittering by said second lamp group.

* * * * *